United States Patent [19]

Etscheid

[11] 4,208,219

[45] Jun. 17, 1980

[54] ARRANGEMENT FOR CONTROLLING THE ADDITION OF A LIQUID

[75] Inventor: Hermann Etscheid, Neustadt, Fed. Rep. of Germany

[73] Assignee: Hermann Etscheid oHG, Neustadt, Fed. Rep. of Germany

[21] Appl. No.: 949,470

[22] Filed: Oct. 10, 1978

[30] Foreign Application Priority Data

Oct. 10, 1977 [DE] Fed. Rep. of Germany ..... 2745498

[51] Int. Cl.[2] ..... B08B 9/08

[52] U.S. Cl. ..... 134/57 R; 134/113; 134/169 R; 119/14.18

[58] Field of Search ..... 134/56 R, 56 D, 57 R, 134/57 D, 113, 166 R, 166 C, 168 R, 168 C, 169 R, 169 C; 119/14, 18

[56] References Cited

U.S. PATENT DOCUMENTS

| | | | |
|---|---|---|---|
| 2,626,620 | 1/1953 | Smith | 134/113 X |
| 2,694,402 | 11/1954 | Phillips et al. | 134/113 X |
| 2,771,892 | 11/1956 | St. Palley | 134/113 X |
| 3,121,536 | 2/1964 | McKibben | 134/168 R X |
| 3,583,412 | 6/1971 | Bender | 134/57 R |
| 3,589,378 | 6/1971 | Swanson et al. | 134/168 R X |
| 3,860,018 | 1/1975 | Reiter | 134/166 R X |

*Primary Examiner*—Robert L. Bleutge
*Attorney, Agent, or Firm*—Michael J. Striker

[57] ABSTRACT

An arrangement for controlling the addition of liquid in the cleaning of containers, especially of milk tanks, has a circulating pump operative for circulating a cleaning liquid withdrawn from a lower part of the container and again sprayed into the container at a higher part thereof, a measuring path flanked by two measuring electrodes directly introduced into the measuring path and incorporated into the circulating arrangement, so that the continuous variations of the electric resistance of the liquid column flowing through the tubular measuring path during the circulation are sensed by the measuring electrodes and transmitted as signals to a control element which converts the signals to a further signal which actuates a closing valve arranged at a liquid inlet conduit.

7 Claims, 5 Drawing Figures

ARRANGEMENT FOR CONTROLLING THE ADDITION OF A LIQUID

Figure 1:
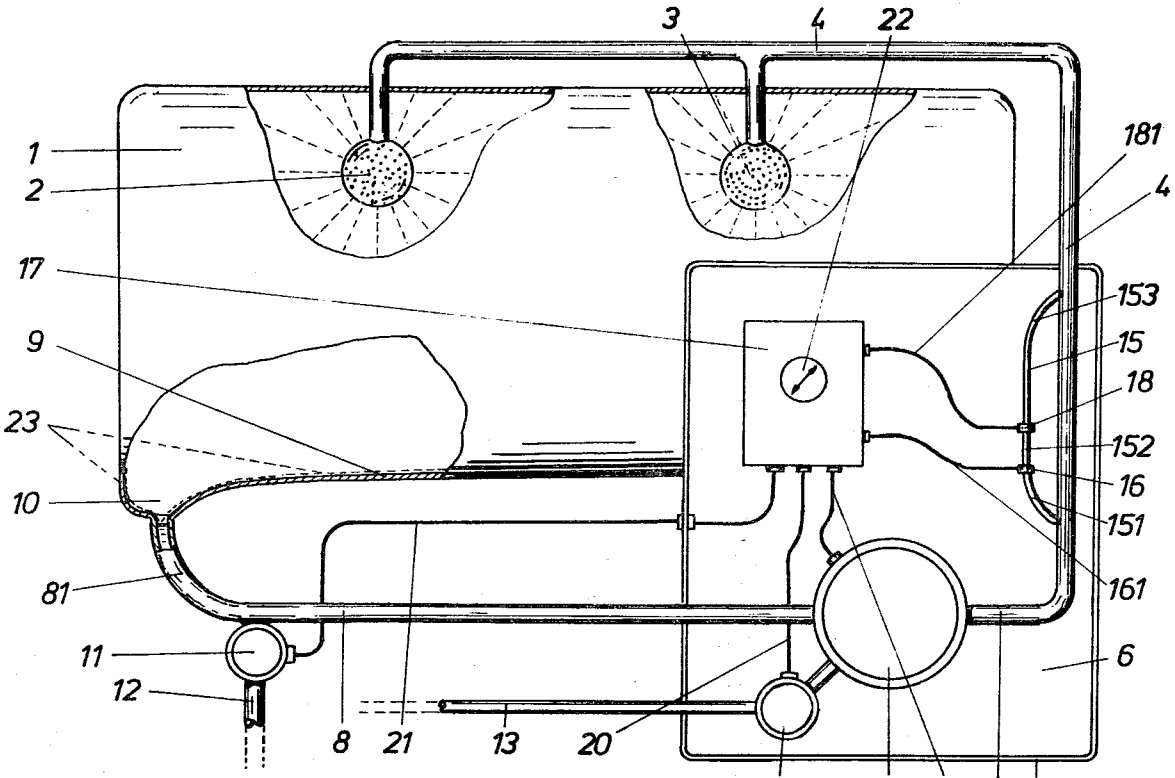

The invention relates to an arrangement for controlling the addition of a liquid, and herein especially the addition of a cleaning liquid during the cleaning of containers, such as, for instance, of milk tanks.

In regard to the consumption of water, washing agents, and heating, as well as with respect also to the cleaning effect and environmental pollution, it is of a decisive importance to use only so much cleaning liquid during the container cleaning as is just necessary and sufficient for the respectively present situation. Where milk tanks are concerned, the cleaning liquid is usually water which obtains an addition of a washing agent in some rinsing operations. An optimal cleaning action is accomplished only as a result of the use of a certain amount of liquid and a certain quantity proportion water/washing agent. The same is true, in the same sense, for containers which are cleaned by other liquids than water; however, it is even more important, for cost reasons as well as because of the environmental pollution, in such cases to limit the liquid amount to that which is just sufficient.

Methods for an automatic metering of washing agents and similar additives are known. Contrarily thereto, it caused significant problems heretofore to accurately meter the basic stock for the cleaning, that is, the liquid amount (in milk tanks: the water amount), without an excessive time loss.

In the generally customary operation for the cleaning of milk tanks, one fills an amount of water, which is recognized as being optimum, and a corresponding amount of washing agents, into the container to be cleaned. The leach which is obtained in this manner is withdrawn by a circulating pump from the lower portion of the container and is sprayed under pressure, through one or more spraying arrangements which are located at suitable locations of the container, on the walls, the ceiling, and the bottom of the container. The measuring of the amount of water consumes too much time, so that this simple method has not been economically feasible any longer for a long period of time, for reasons of time consumption and of the cost of borrowed money as well.

Therefore, there became known several automatically operating cleaning arrangements in which the amount of water is simply metered in that one lets the water flow from the water duct into the container for a certain period of time. However, the water pressure in almost all water ducts varies within a wide range; variations of 50% and more are not uncommon. Hence, the measuring of the water amount in accordance with the filling period of time is extremely uncertain. Now, in order to assure that one has always supplied a sufficient amount of water for an effective cleaning, one selects a filling period of time which is longer by 30 to 50% than that necessary at normal water pressure, and thus often supplies much more water than necessary into the container. In correspondence therewith, one also needs more of the washing agent, in order to obtain an optimally effective leach, but one has no assurances that the quantity proportion water/washing agent is in conformity, at least approximately. It is only certain that the costs, when this method is resorted to, are much higher than necessary, and that not only the costs for water, washing agent and heating, but also the costs connected with environmental protection.

A metering arrangement which became known in recent years includes an electrode which is arranged in the washing installation in question. As long as the level of the body of cleaning water present at the bottom of the container does not reach upto this electrode, additional water flows into the container. On the other hand, as soon as the upper surface of the body of water contacts the electrode, a current pulse closes the water inlet. This arrangement has the disadvantage that the water can enter only slowly, in order for the electrode not to be contacted too early by water waves, which can easily be the case especially when the upper surface of the body of water is low and wide. Furthermore, the accuracy of this method is dependent on always the same position of the bottom of the tank. The electrode must be specially adjusted for each individual tank and, when the tank is moved, one must readjust the electrode after each movement.

What is common to the heretofore known automatic metering arrangements is that the cleaning liquid forms a so-called "lake" at the bottom of the container to be cleaned, which has a height of several centimeters. The existence of such a "lake" is indispensable for the above-described electrode control. In the region of the lake, the mechanical components of the cleaning action are inoperative, inasmuch as the liquid droplets which are being sprayed by the spraying arrangements are prevented from impinging upon the corresponding part of the container bottom. In addition thereto, the movement of the cleaning liquid is much slower and thus correspondingly less effective at the container bottom which is situated in the region of the "lake". As a consequence thereof, only a part of the chemical cleaning action occurs at this part of the container bottom. The absence of a mechanical cleaning action is especially disadvantageous when it is being merely rinsed with pure water—that is, without the addition of washing agent—, such as, for instance, during the prerinsing or afterrinsing.

The present invention has for its object, in the cleaning of containers, particularly of milk tanks, in which the cleaning is accomplished by means of a rinsing liquid which is being circulated by a circulating arrangement, to provide an arrangement for controlling the addition of a liquid, by means of which the addition of the liquid always corresponds to an amount of liquid which is just sufficient for an optimal cleaning, can be continuously automatically controlled and supplemented in accordance with need. Moreover, the formation of a body of the cleaning liquid—of a so-called "lake"—at the bottom of the container is to be effectively prevented, in that the cleaning liquid briskly flows not only on the container walls, but also over the container bottom as well, so that the mechanical as well as the chemical cleaning effect is fully utilized even on the entire bottom surface. Finally, one should be able to selectively either rigidly connect the arrangement according to the invention with a certain container, or to arbitrarily attach the same to a portable washing device or to portable containers and, consequently, to handle a plurality of containers, one after another, with one and the same arrangement.

These objects of the invention are achieved in that a measuring path flanked by two measuring electrodes is incorporated in the circulating arrangement. Continuous changes in the electrical resistance of the liquid column passing through the measuring path in the course of the cycling are monitored and supplied as signals to a control equipment. The latter converts these signals into control signals that actuate a closing valve arranged in a fluid inlet line. In a preferred embodiment of the invention, the measuring path is provided in a by-pass established at the pressurized pipe conduit of the circulating arrangement. Advantageous is when the control element contains two electronic control systems, either of which receives the measuring signals of its own, and either of which converts these signals by itself into command signals for the opening and closing of the closing valve. Here one of the systems reacts to high resistance values and the other only to resistance changes.

Also a fork can be formed at the pressurized pipe. With a shorter one of this fork tines, one end of the by-pass communicates, while the other fork tine forms a loop, before the pressurized pipe extends further upwardly, where the other end of the by-pass then communicates therewith.

The measuring path which is situated in the by-pass may be transparent. To an advantage, the suction conduit can communicate with the lowest point of the container bottom from underneath, and the entire arrangement can be a unit which is spatially independent from the container that is to be cleaned.

Figure 2:
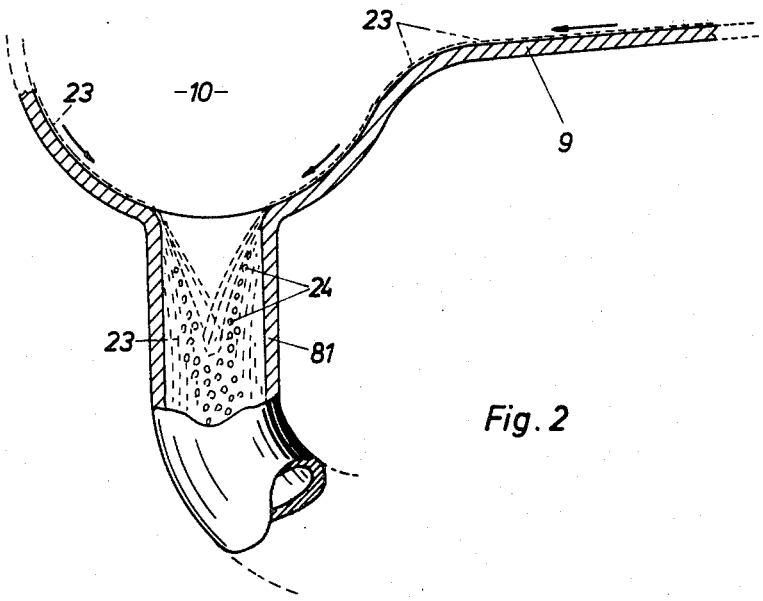
Figure 3:
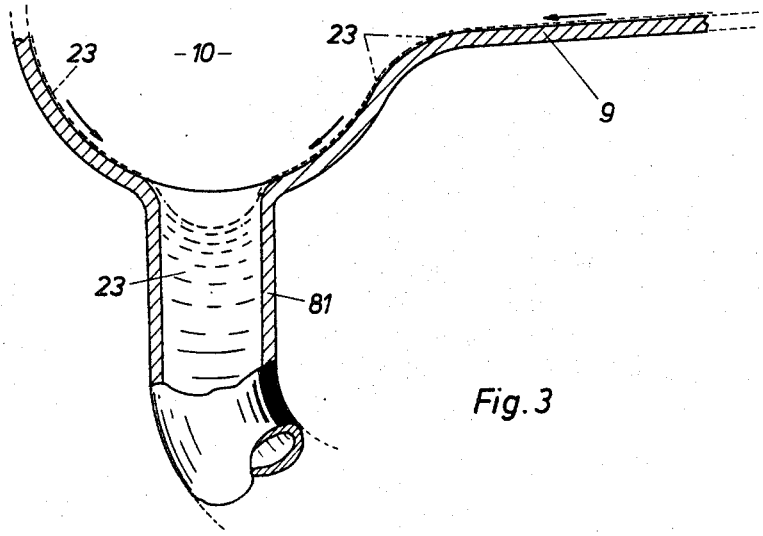
Figure 4:
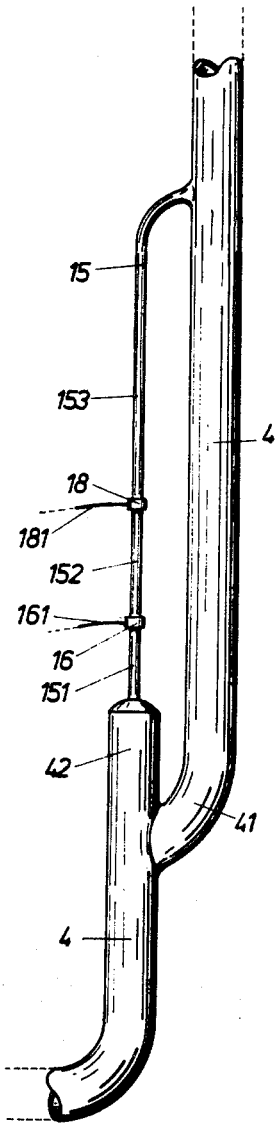
Figure 5:
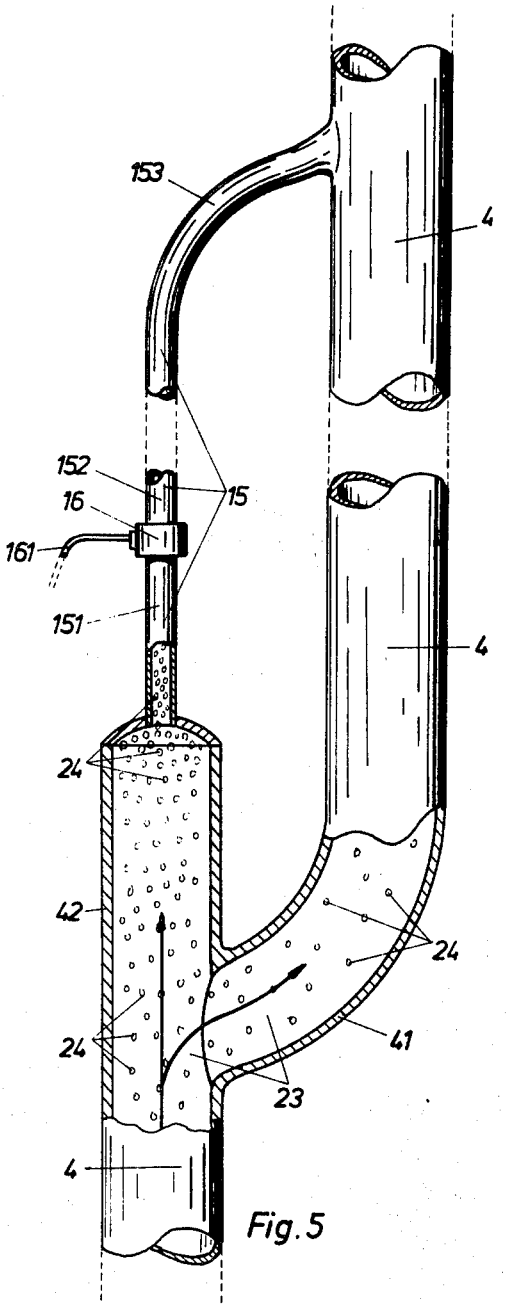

An example of the embodiment of the present invention will be illustrated and explained with reference to the drawings. The same show:

FIG. 1 a container with an arrangement according to the invention for controlling the addition of liquid connected thereto, in a side elevational view and partially in section, whereas the lid is removed from the arrangement, FIG. 2 the withdrawal part (discharge part) of the container, with a withdrawing pipe of the circulating arrangement connected thereto, where the amount of the cleaning liquid is insufficient, in a side elevational view and in section, FIG. 3 the withdrawal part of FIG. 2, but where the amount of the cleaning liquid is sufficient, FIG. 4 a preferred embodiment of the by-pass arranged at the pressurized pipe of the circulating arrangement, in a side elevational view and, FIG. 5 the enlarged partial view of the arrangement of FIG. 4, in front elevation and partially in section.

The exemplary embodiment which is illustrated in FIGS. 1 to 5 is related to a milk tank with an arrangement in accordance with the present invention for controlling the addition of water, but it is applicable in principle even to other containers to be cleaned and to other cleaning liquids. As shown in FIG. 1, two spraying arrangements 2,3 are arranged at the upper part of the container 1, from which a pressurized pipe conduit 4 leads into the housing 5 of the control arrangement 6 and is connected to a circulating pump 7 situated thereat. A suction pipe conduit 8 extends from the other side of the circulating pump 7 to a depression 10 formed in the bottom 9 of the container 1. The container bottom 9 has a slight incline toward the depression 10; when the depression 10 is located—as in FIG. 1—at one end of the container, this incline can be simply brought about in that the container is positioned slightly askew.

A magnetic valve 11 is arranged at the suction pipe conduit 8, which is being controlled by the control arrangement 6, and through which the end portion 81 of the suction pipe conduit 8 is closably connected with a discharge conduit 12. The entire cleaning liquid can be discharged from the container through this discharge conduit.

A usable water conduit 13 leads from the exterior into the interior of the arrangement 6, where it communicates with the circulating pump 7. A second magnetic valve 14 is arranged in this usable water conduit 13. Customarily, two usable water conduits will be provided, and that one for cold and the other for hot water. In order not to unnecessarily complicate the drawing and the presentation, only one of these conduits has been illustrated and described in this example of the embodiment.

In the interior of the arrangement 6, there is provided at the pressurized conduit 4 a branch conduit, a so-called bypass 15, the cross-sectional area of which is smaller than the cross-sectional area of the pressurized conduit 4. The lower part 151 of the by-pass 15 is of a metal and belongs, in the electrotechnical sense, to the mass of the total arrangement. The middle part 152 of the by-pass commences at the end of the lower part 151, being made of an insulating material. At the contact region 151,152, there is situated a tubular measuring electrode 16 which is connected with the metallic tube 151, and which is connected, via a connecting conduit 161, with an electronic control element 17. The upper part 153 of the by-pass 15, which again communicates with the pressurized conduit 4, is made of an insulating material. A second tubular electrode 18 is located between the middle and upper parts 152,153, which is connected with the control element via a connecting conduit 181. Both measuring electrodes 16, 18 are passed through by cleaning liquid. The middle part 152 which is flanked by the two measuring electrodes 16,18 constitutes a measuring path for a continuous automatic measurement of the ohmic resistance of the cleaning liquid flowing through the by-pass 15 and the two tubular measuring electrodes 16,18.

The electronic control element 17 is connected by further conduits 19 with the circulating pump 7, 20 with the usable water closing valve 14, and 21 with the discharge valve 11. Furthermore, the control element 17 is equipped with a switching clock, a so-called timer 22.

The metering arrangement operates as follows: At the beginning of the cleaning operation, the usable water valve 14 is opened and the circulating pump 7 switched on. The water flows into the interior of the container 1 through the circulating arrangement 4,7,8, in that it is sprayed by the spraying arrangements 2,3 onto the walls, the ceiling, and the bottom of the container. The possible addition of a washing agent is not being described here in any great detail, since, as already mentioned at the outset, an automatic metering of washing agents is already known and also otherwise does not belong to the invention.

The sprayed water or the sprayed cleaning liquid 23 (FIG. 2) flows downwardly on the container walls and the container bottom 9, toward the depression 10 of the container bottom. Before the liquid has had an opportunity to accumulate thereat to form a "lake", it is withdrawn through the suction pipe 8, comp. FIGS. 2 and 3. When an insufficient amount of liquid is present in the circulating arrangement 4,7,8, as is always the case during the initial phase of operation in any event, air is being continuously drawn into the suction pipe. Beginning with a certain amount of water, a whirlpool forms at the upper end 81 of the suction pipe 8, comp. FIG. 2. The turbulences of this whirlpool entrain air inclusions 24 for travel into the suction pipe 8. These air inclusions represent a criterion for the fact that the container 1 and the circulating arrangement 4,7,8 obtain a sufficient amount of the cleaning liquid: in the event that the liquid flowing through the by-pass is penetrated by air inclusions, liquid is still missing, when the air inclusions cease to exist, enough of the cleaning liquid has flown in.

The example of the embodiment described herein is related to a metering arrangement 6 which comprises two electronic control systems arranged in the control element 17. Both control systems react to the voltage which respectively exists at the measuring electrodes 16, 18, and each of them individually converts the signals emanating from the measuring electrodes into the signal which causes the actuation of the usable water valve 14. Such electronic systems are commonly known; for the reasons of lucidity, they have consequently not been further described herein and also have not been illustrated in the drawings.

The metering arrangement operates as follows: upon the commencement of the cleaning operation, the circulating pump 7 begins to operate, and water is being added. Both control systems I and II are active. Only air is initially present in the measuring path 152; the ohmic resistance of the measuring path, consequently, amounts to $\infty$ initially, but it decreases afterwards, when the water flows in, rather rapidly. When the resistance of the measuring path has dropped, after several seconds, to a pre-determined final value, the signal emitted by the control system I ceases, which causes the usable water valve 14 to assume its open position.

Should, for any reason whatsoever, no water flow in, that is, when the measuring electrodes 16 still signal a resistance amounting to $\infty$ after a predetermined period of time, such as after 20 seconds, the control system I discontinues the operation of the arrangement as a whole. This security measure has the purpose to avoid the possibility that the circulating pump would run dry; it can, when desired, also be applicable to the entire duration of the cleaning operation.

In addition thereto, the control system I can be used for a metering of washing agents, and this also under the utilization of the principle which has been just described for the water filling.

The control system II reacts to the changes of the ohmic resistance of the measuring path 152, in that it transmits a signal to the usable water valve 14 at the occurrence of each voltage change at the measuring electrodes 16,18, be it a voltage increase or a reduction in voltage, which signal then causes, through a corresponding switching member, the opening position. These signals occur with a small predetermined delay. The voltage changes at the measuring electrodes are caused by air inclusions, in that each air bubble which passses through the by-pass, beginning with a certain size, results in a continuous change in the ohmic resistance.

In this manner, the liquid amount is being held at an optimum, and this without the resistance existing in the measuring path 152 by itself, or the value of the voltage present at the measuring electrodes 16,18 being determinative for the function of the metering arrangement. Each time that air inclusions 24 are entrained for travel into the suction pipe 8, the resistance of the measuring path varies, and a signal for opening or holding open of the usable water valve 14 follows each such variation. However, as soon as the optimal amount of the liquid is filled in, no more air inclusions appear any longer. The decision to what an extent the rinsing liquid is to be free of air inclusions prior to the closing of the usable water valve 14 can be brought to reality by the adjustment of a potentiometer (not illustrated).

It is apparent from this illustration that, as already mentioned, the resistance by itself is not determinative for the metering of the addition of the liquid, but the amount of the liquid is. When the amount of the liquid is exactly so large that the situation apparent from FIG. 3 exists, no changes of the resistance take place, and the usable water valve 14 remains closed. However, when the amount of the water, as shown in FIG. 2, is slightly smaller, air inclusions 24 are entrained for travel into the circulating arrangement. The resistance of the measuring path 152 varies: the usable water valve 14 is opened. However, the usable water valve 14 remains open even in the course of the decrease of the amount of resistance which follows thereafter because of the fresh water which flows in, and it closes only when the amount of resistance has become, for all intents and purposes, constant. The optimum amount of water is achieved only then, and the situation illustrated in FIG. 3 is present. An optimum amount of water is defined as that amount of the cleaning liquid which assures a saturated operation of the circulating pump at the lower limit of the amount, that is, when using the lowest possible amount of the liquid, in order for the spraying arrangements 2,3 to operate at a highest possible pressure.

Should one content oneself with an arrangement according to the control system I, one would be able to so meter the liquid with this simpler arrangement, without encountering any problems, that the usable water valve 14 would be closed at reaching a predetermined value of the resistance of the measuring path 152. However, the amount of liquid present in the measuring path 152 would then have to have always the same value of the resistance without air inclusions, which is not the case especially with tap water which many a time has very difficult values of the resistance. It is to be added thereto that a considerably different value of the resistance is encountered after a pre-occuring washing operation than, for instance, in connection with clear water.

Only the utilization of the discussed two control systems which act in parallel on the usable water valve 14 renders it possible to obtain a metering of the addition of liquid which is exclusively correlated to the liquid volume, that is, the metering arrangement operates, as far as the volume is concerned, just as well, whether different water provenances, different leaches, or even other cleaning liquids are now being used.

A particularly advantageous arrangement of the by-pass 15 is illustrated in FIGS. 4 and 5. Herein, the pressurized conduit 4 forks, in that it forms a loop 41, wherein it possesses a short extension 42 next to this loop, which extends in the previous axial direction. The by-pass 15 with the measuring path 152 is connected to the extension 42 with the lower end 151 thereof, while the upper end 153 of the by-pass communicates with the further progression of the pressurized pipe 4.

FIG. 5 shows this arrangement in an enlarged partial front elevational view, partially in section. The air inclusions 24 which are entrained for travel into the suction pipe 8 and forwarded to the pressurized pipe 4 are collected, to the larger part, in the short fork piece 42 of the pressurized pipe and are pressed from there into the by-pass 15. As a result of this, at the same total amount of air inclusions, relatively much more air inclusions are present in the measuring path 152 than in a by-pass arrangement according to FIG. 1, in which the air inclusions are distributed into the pressurized pipe 4 and the by-pass 15 in correspondence with the cross-sectional areas. Therefore, it is possible, when using a by-pass arrangement according to FIGS. 4 and 5, to give a considerably larger band width to the variations of the ohmic resistance in the measuring path 152, as a result of which the sensitivity of the metering arrangement and, as a consequence thereof, also the accuracy of the addition of the liquid, can be still substantially improved.

It is to be monitored as a precaution that the invention can also be realized without the provision of a by-pass, in that one arranges the electrodes 16,18 directly at the pressurized pipe 4 and performs the measurement of the resistance directly in the liquid column flowing through thereat. To this end, it is necessary to manufacture that part of the pressurized conduit which constitutes the measuring path of an insulating material. The important advantage of the by-pass resides in the fact that, as a result of the narrowing of the cross section and the division of the stream in two channels, the speed of flow of the liquid flowing through is diminished, so that the liquid flows past the measuring electrodes at a slower pace. A further advantage is that one is able to make the measuring path 152, which has to be made, together with the upper part 153 of the by-pass, of an insulating material in any event, transparent and thus to render an easy optical supervision of the throughflow possible. Finally, the especially sensitive measuring path which is illustrated in FIGS. 4 and 5 is possible only in connection with a bypass.

The exemplary embodiment is related to the utilization of an electronic control element which controls a pre-programmed automatic operation of the cleaning procedure in its entirety. Such electronic switching and control elements are known and can be inexpensively manufactured with the aid of the modern transistor technology. They, however, have nothing to do with the invention by itself and, for this reason, they have not been described in detail herein. The invention is in no way dependent on the presence of an electronic control element, but rather it can be realized even without resorting to the same, for instance, by utilizing a simple relay arrangement by means of which a weak signal acting at the measuring path 152 is converted into a strong signal for the actuation of the closing valve 14.

In the simplest embodiment of the invention, the air inclusions which are produced by joint withdrawing of air at the inelt opening of the suction pipe 8 are optically perceived in the measuring path 152, in that the measuring path of the by-pass consists of a transparent pipe of glass or synthetic plastic material. Such an optical perception can be especially well performed in the by-pass arrangement such as that of FIGS. 4 and 5, inasmuch as the variation width of the air inclusion amount is much greater than in an arrangement according to FIG. 1. The closing valve 14 is then manually operated in correspondence to this perception, as well as the discharge valve 11.

It is to be finally mentioned that the switching pulses need not necessarily by electrical; rather, they can also be triggered by pressure variations in the circulating system, in that the pump pressure strongly decreases in the presence of larger air inclusions.

The arrangement according to the invention need not be rigidly connected with the container to be cleaned; rather, one can selectively treat a multitude of containers after each other with one and the same device. In this event, the pressurized and suction pipes 4,8 are connected via pressurized hoses (not illustrated) with corresponding nipples (also not illustrated) arranged at the container 1.

I claim:

1. Arrangement for controlling the addition of liquid in the cleaning of containers, especially of milk tanks, in which the cleaning is accomplished by means of a cleaning liquid which is being circulated by a circulating pump, in that the cleaning liquid is withdrawn at the lower part of the container and is again sprayed into the container by at least one spraying arrangement which is situated at a container part that is located higher, the improvement wherein that a measuring path which is flanked by two measuring electrodes is incorporated into the circulating arrangement, at which the continuous variations of the electric resistance of the liquid column respectively flowing through the measuring path during the circulation are transmitted to a control element which converts the signals in a further signal which actuates a closing valve arranged at a liquid inlet conduit; and two control systems are formed in the control element, each of which is connected by itself with the measuring electrodes and receives the measuring signals emitted by the same, and each of which by itself converts these measuring signals into signals for the switching member actuating the usable water valve, wherein the first control system is active at high values of the resistance from $\infty$ downwardly, while the other control system reacts exclusively to variations of the values of the resistance.

2. Arrangement for controlling the addition of liquid in the cleaning of containers, especially of milk tanks, in which the cleaning is accomplished by means of a cleaning liquid which is being circulated by a circulating pump, in that the cleaning liquid is withdrawn at the lower part of the container and is again sprayed into the container by at least one spraying arrangement which is situated at a container part that is located higher, the improvement wherein a measuring path which is flanked by two measuring electrodes is incorporated into the circulating arrangement, at which the continuous variations of the electric resistance of the liquid column respectively flowing through the measuring path during the circulation are transmitted to a control element which converts the signals in a further signal which actuates a closing valve arranged at a liquid inlet conduit, the measuring path is arranged at a by-pass that is formed at the pressurized pipe conduit (4) of the circulating arrangement, and a bifurcation provided with a shorter and a longer fork piece is formed at the pressurized pipe conduit of the circulating arrangement, of which the shorter fork piece extends in the previous axial direction of the pressurized pipe conduit, and to which the one end of the by-pass is connected, whereas the long fork piece forms a bend or a loop with a part of which, that is spaced from the bifurcation, the second end of the by-pass communicates.

3. Arrangement for controlling the addition of liquid in the cleaning of containers, especially of milk tanks, in which the cleaning is accomplished by means of a cleaning liquid which is being circulated by a circulating pump, in that the cleaning liquid is withdrawn at the lower part of the container and is again sprayed into the container by at least one spraying arrangement which is situated at a container part that is located higher, the improvement wherein a tubular measuring path which is flanked by two measuring electrodes directly introduced into the tubular measuring path is incorporated into the circulating arrangement, at which the continuous variations of the electric resistance of the liquid column respectively flowing through the tubular measuring path during the circulation are sensed by the measuring electrodes and transmitted as signals to a control element which converts the signals in a further signal which actuates a closing valve arranged at a liquid inlet conduit.

4. Arrangement according to claim 3, characterized in that the measuring path (152) is arranged at a by-pass (15) that is formed at the pressurized pipe conduit (4) of the circulating arrangement (4,7,8).

5. Arrangement according to claim 3, characterized in that the measuring path (152) which is arranged in the by-pass (15) consists of a transparent material.

6. Arrangement according to claim 3, characterized in that the suction pipe conduit (8) of the circulating arrangement (4,7,8) communicates, from underneath with the deepest location (10) of the container bottom (9).

7. Arrangement according to claim 3, characterized in that the arrangement (6) constitutes a unit which is spatially independent from the respective container (1) to be cleaned.

* * * * *